United States Patent [19]

Readman

[11] Patent Number: 4,875,826

[45] Date of Patent: Oct. 24, 1989

[54] PITOT PUMP ASSEMBLY FOR A ROTATING FLUID MANAGEMENT DEVICE

[75] Inventor: John Readman, Rockford, Ill.

[73] Assignee: Sundstrand Corporation, Rockford, Ill.

[21] Appl. No.: 224,344

[22] Filed: Jul. 26, 1988

[51] Int. Cl.[4] ..... F04D 1/12

[52] U.S. Cl. ..... 415/89; 415/201; 29/156.8 R

[58] Field of Search ..... 415/88, 89, 201; 494/56, 57, 58; 417/353; 29/156.8 R

[56] References Cited

U.S. PATENT DOCUMENTS

| | | | |
|---|---|---|---|
| 3,004,495 | 10/1961 | Macklis | 415/89 |
| 3,384,024 | 5/1968 | King | 415/89 |
| 3,791,757 | 2/1974 | Tarifa et al. | 415/88 X |
| 3,822,102 | 7/1974 | Erickson et al. | 415/89 |
| 3,936,214 | 2/1976 | Zupanick | 415/89 |
| 4,044,943 | 8/1977 | Brown et al. | 415/89 X |
| 4,059,364 | 11/1977 | Andersen et al. | 415/89 |
| 4,264,269 | 4/1981 | Erickson et al. | 415/89 |
| 4,280,790 | 7/1981 | Crichlow | 415/89 |
| 4,281,962 | 8/1981 | Erickson | 415/89 |
| 4,549,861 | 10/1985 | Blain | 418/55 |
| 4,674,950 | 6/1987 | Erickson | 415/88 |

FOREIGN PATENT DOCUMENTS

| | | | |
|---|---|---|---|
| 2419428 | 4/1974 | Fed. Rep. of Germany . | |
| 1262135 | 10/1986 | U.S.S.R. | 415/89 |
| 1373876 | 2/1988 | U.S.S.R. | 415/89 |
| 852653 | 10/1960 | United Kingdom . | |

*Primary Examiner*—Robert E. Garrett
*Assistant Examiner*—Joseph M. Pitko
*Attorney, Agent, or Firm*—Wood, Dalton, Phillips Mason & Rowe

[57] ABSTRACT

A pitot pump assembly including a rotating drum 12 having a central bore 14 and a cavity 20 between its two axial ends and at least one radially extending opening 22. A stationary shaft 24 is inserted within the bore 14 and includes a plurality of fluid passages 26. The shaft 24 has one or more bearing surfaces 28 and sealing surfaces 30 between the shaft 24 and the rotating drum 12. A unitary pitot sub-assembly 32 is inserted through the radial opening 22 of the rotating drum 12 and has one or more radially extending pitot tubes 36 in which to receive fluid from within the cavity 20 of the rotating drum 12. A sleeve 48 is disposed on the rotating drum 12 for sealing the opening(s) 22 and an outer housing 52 is secured to the stationary shaft 24 and encases the rotating drum 12.

10 Claims, 2 Drawing Sheets

PITOT PUMP ASSEMBLY FOR A ROTATING FLUID MANAGEMENT DEVICE

FIELD OF INVENTION

This invention relates to a pitot pump, and more particularly, to a pitot pump assembly for a rotating fluid management device.

BACKGROUND OF THE INVENTION

Many types of conventional pitot pumps include a rotating drum that rotates around a stationary shaft and encases a pitot assembly. Fluid flows into the drum through inlets to be picked up by the pitot assembly and flowed out passages in the shaft. Commonly, the rotating drum includes several separately machined parts that are secured to each other and assembled around the pitot assembly. See, for example, U.S. Pat. No. 4,059,364 issued Nov. 22, 1977 to Andersen et al. There are problems with this, however. Bearing and sealing surfaces between the rotating drum and shaft upon which the drum rotates are not precisely aligned causing tolerance stack up which results in leakage and a decrease in the overall efficiency of the system. Secondly, there is the increased cost of material and labor adding to the inconvenience and difficulty in designing, machining and securing the independent pieces around the pitot assembly. Additionally, because the bearing and sealing surfaces are not precisely aligned, the rotating drum and shaft incur significant wear and tear on the surfaces as the drum does not rotate uniformly on the shaft. The wear exacerbates already existent sealing problems.

The present invention is directed to overcoming one or more of the above problems.

SUMMARY OF THE INVENTION

It is the principle object of the invention to provide a new and improved pitot pump assembly. More specifically, it is an object of the invention to provide an efficient, relatively leak-free and inexpensive, easy to fabricate pitot pump assembly.

According to one facet of the invention, a pitot pump assembly includes a rotating drum including a bore and at least one radially extending opening. The drum has a cavity between its two axial ends in which fluid to be pumped is received. A shaft, with axial extending fluid passages, is disposed within the bore, with at least one or more sealing and bearing surfaces located between the shaft and the rotating drum. A unitary pitot subassembly with one or more radially extending pitot tubes is inserted through the radial opening of the drum and disposed within the cavity to be mounted on the shaft therein. Means are provided to seal the opening on the rotating drum and an outer housing is secured to the stationary shaft and encases the rotating drum.

The present invention permits the rotating drum to be machined from a single piece and bored during a single boring operation, thereby providing concentric bearing and sealing surfaces of the same diameter resulting in an efficient, well sealed pitot pump. Also, thrust surfaces are formed during the single boring operation, permitting the thrust surfaces to be aligned perpendicular to the bore. Additionally, time, labor and materials are minimized, as separate pieces do not have to be individually designed, machined and fitted. Further, because the bearing and sealing surfaces are precisely aligned, dynamic films at the bearing and sealing surfaces are maintained at a minimum clearance and the wear and tear on the drum and shaft are minimized.

In a preferred embodiment, the rotating drum is cylindrical.

In a highly preferred embodiment, the rotating drum contemplates that the bore constructed during a single boring operation intersects a cavity disposed between the drums' two axial ends. Fluid is received in the cavity at one axial end of the drum. The drum has at least one opening extending between its periphery and the cavity. A stationary shaft of uniform diameter within the bearing and sealing surfaces is inserted within the bore, the shaft including a plurality of nonconcentric fluid passages extending throughout a portion of its axial length. There are at least two concentric sealing and bearing surfaces between the shaft and the rotating drum, the surfaces having the same diameter and being formed during a single boring operation as mentioned earlier. Additionally, opposite facing, parallel thrust surfaces are formed during the boring operation and are perpendicular to the bore. A pitot sub-assembly with one or more radially extending tubes is disposed within the cavity and secured to the stationary shaft. A sleeve is disposed around the rotating drum sealing the opening in the drum and an outer housing is secured to the stationary shaft encasing the sleeve and the drum.

Other objects and advantages will become apparent from the following specification taken in connection with the accompanying drawings.

DESCRIPTION OF THE PREFERRED EMBODIMENT

Figures 1, 2:
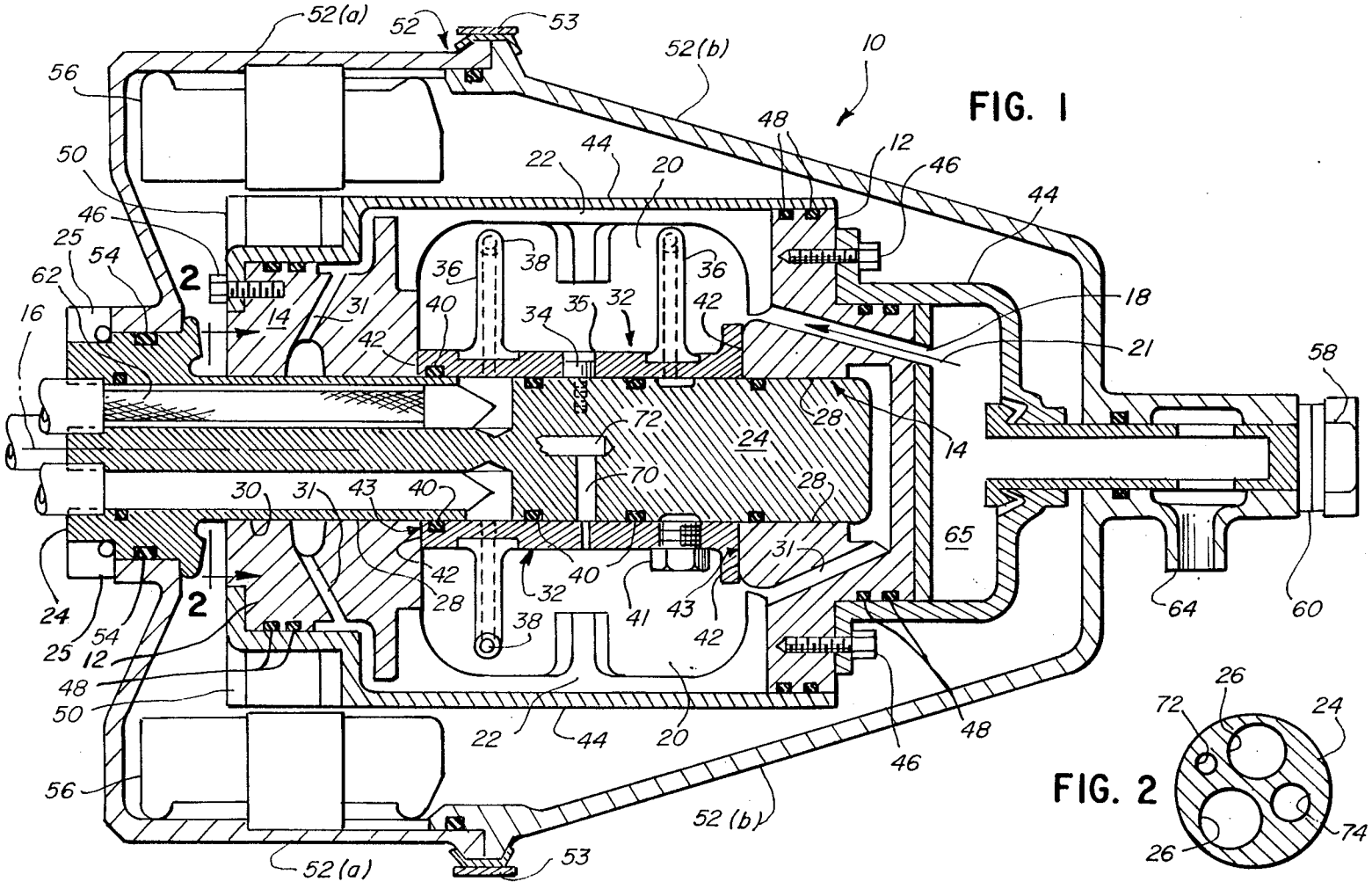
FIG. 1 is a sectional view along the rotational axis of the pitot pump assembly illustrating two radially extending openings through the periphery of the rotating drum and a plurality of flow paths through the rotating drum.
FIG. 2 is a sectional view of the stationary shaft and fluid passages taken along the line of 2—2 of FIG. 1.
Figure 3:
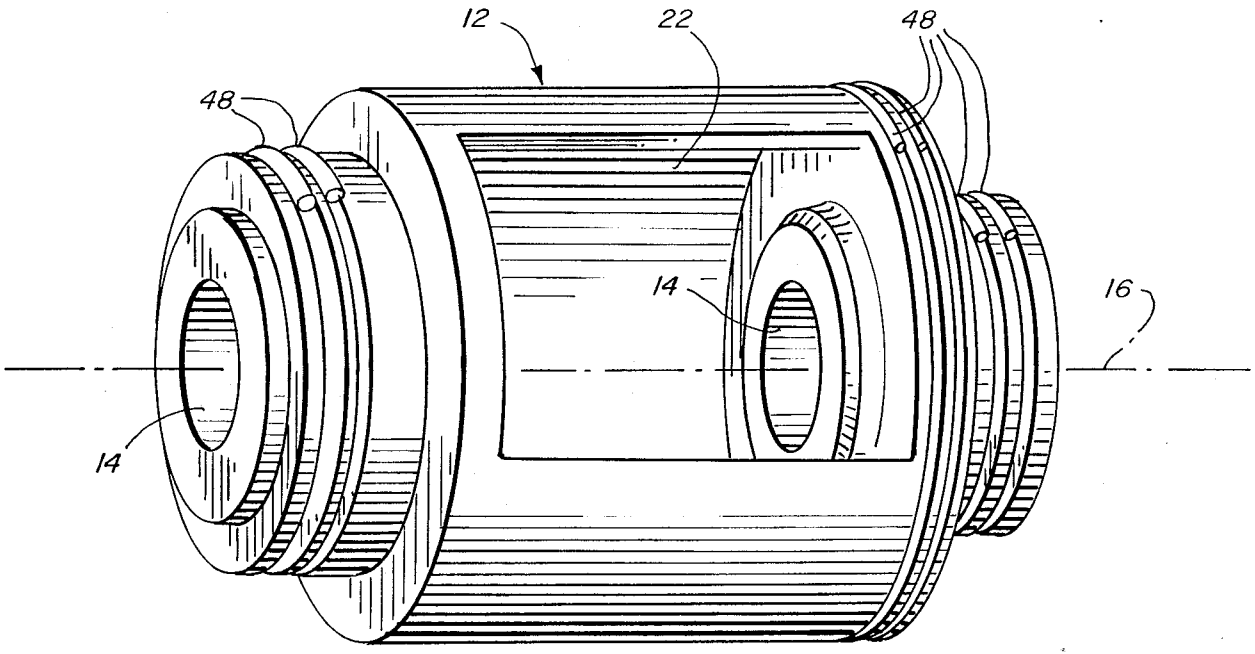
FIG. 3 is a perspective view of the pump rotor or drum without the encasing sleeve, illustrating the central bore and an opening through the periphery of the rotating drum for the insertion of the pitot pump subassembly.

An exemplary embodiment of a pitot pump assembly 10 is illustrated in the drawings. The invention is not restricted to any specific use and may have applicability with any machine utilizing a pitot pump.

The pitot pump assembly 10 includes a cylindrical rotating drum 12 machine from a single piece such as a casting. The drum 12 has a central bore 14 that is machined during a single boring operation. The rotating drum 12 and the central bore 14 have a common longitudinal axis 16, extending therethrough.

The drum 12 includes flow paths defined by conduits 18 in which fluid flows from one end of the drum 12 into a cavity 20 that is disposed between the ends of the drum 12. The cavity 20 is intersected by the bore 14. The flow of the fluid is generally shown by arrows 21.

Openings 22, generally two in number, extend through the periphery of the drum 12 and intersect the cavity 20 to provide assembly of a pitot pump subassembly to be described in greater detail hereinafter. The openings 22 are located diametrically opposite on the drum so as to attain dynamic balance; however, this invention does not restrict the number of openings or the location of the openings, as other means can be utilized to attain dynamic balance.

A cylindrical stationary shaft 24 is disposed within the central bore 14 of the drum 12 and is supported by a nut 25 to housing 52(*a*), which will be more fully discussed below. The longitudinal axis of the shaft 24 is the same as the longitudinal axis 16 of the central bore 14 and rotating drum 12 and the shaft 24 journals the drum 12 for rotation about the axis 16.

The stationary shaft 24 has a plurality of separate nonconcentric passages 26. The passages 26 begin between the two axial ends of the shaft 24 and plural passages terminate in the same transverse planes (to the left in FIG. 1). In comparison, conventional concentric passages require each passage to terminate in a different transverse plane. As a result of the nonconcentricity of the passages 26, the overall axial length of the shaft 24, and thus the machine itself, is decreased. Further, a number of seals that would be needed if the passages 26 were concentric are eliminated.

Two bearing surfaces 28 and one sealing surface 30 are disposed between the rotating drum 12 and the stationary shaft 24. The bearing surfaces 28 and the sealing surface 30 are machined during the single boring operation and thus are concentric, have the same diameter, and as a result are precisely aligned. The single boring and facing operation produces a very high degree of precision in the concentricity of bearing surfaces 28 and sealing surface 30 and in the perpendicularity of thrust bearing surfaces 43 relative to bearing surfaces 28. Also, the O-rings 40 provide the dual function of providing seals for working fluid and, additionally, permitting the alignment of the thrust surfaces 42 and thrust bearings 43.

Bearing and sealing drain returns 31 are provided in the rotating drum 12 to permit fluid to circulate between cavity 20 and bearing and sealing surfaces 28 and 30.

A unitary pitot sub-assembly 32, referred to previously, is disposed within the cavity 20 of the rotating drum 12. The pitot sub-assembly 32 is inserted through the radially extending opening(s) 22 of the rotating drum 12 prior to the insertion of the stationary shaft 24. The pitot sub-assembly 32 is located axially to the shaft 24 by a bolt 34. The bolt 34 is disposed within the shaft 24 in an opening 35 in the pitot sub-assembly 32 and limits rotation and axial movement of the pitot sub-assembly 32 relative to the stationary shaft 24 by providing location and torque (axial and circumferential) reaction caused by the drag of the tips of the pitot tubes 36. The pitot sub-assembly 32 includes a plurality of radial extending pitot tubes 36 having radially outer tangential inlets 38 which open opposite the intended direction of rotation of the rotating drum 12 in which to receive fluid from within the cavity 20. O-rings 40 are disposed between the shaft 24 and the pitot sub-assembly 32 to prevent leakage therebetween.

Two-phase material is conveyed through the pitot tube 36 and to a spray nozzle 41 disposed on the pitot sub-assembly 32, the spray nozzle 41 exhausts the fluid back down into the cavity 20, and thus allows undesirable droplets to conglomerate on the cavity wall.

The pitot sub-assembly 32 includes oppositely axially facing thrust surfaces 42 which engage the interior aligned surfaces of the rotating drum 12 to define thrust bearings 43. The thrust surfaces 42 are machined during the single boring operation and as a result are perpendicular to the central bore 14. Due to the resiliency of the O-rings 40, the pitot sub-assembly 32 is allowed to cant slightly on the shaft 24 to achieve parallelism on the surfaces defining the thrust bearings 43, thereby reducing wear.

A cylindrical sleeve 44 encases the rotating drum 12 and is rotatable therewith. The cylindrical sleeve 44 seals the openings 22 on the rotating drum 12 and bolts 46 secure the sleeve 44 to the drum 12. O-rings 48 are disposed between the drum 12 and the sleeve 44, preventing leakage therebetween.

An electric motor rotor 50 such as a conventional squirrel cage rotor, is rigidly secured to and thus is rotatable with the sleeve 44. An outer housing 52 encases the sleeve 44 and mounts one end of the stationary shaft 24. The housing 52 includes two separate pieces, 52(*a*) and 52(*b*) secured to its periphery by fasteners 53. An O-ring 54 is disposed between the shaft 24 and outer housings 52(*a*) to prevent leakage therebetween. The housing 52 includes an electrical motor stator 56, also conventional, secured thereto. The electric motor defined by the motor rotor 50 and the motor stator 56 when energized, cause the drum 12 to rotate to operate the pump.

In use, a transfer tube 58 connects the pitot pump 10 to any machine that utilizes a pitot pump and is secured to the pitot pump by a locating pin 60. Fluid is returned to the machine via a port 64 through chamber 65 and the transfer tube 58 and enters the pitot pump 10 through the conduits 18 in the rotating drum 12. The fluid is received in the cavity 20 of the drum 12 an when sufficient fluid accumulates radially outwardly in the cavity 20 so as to encounter the radially outer tangential inlets 38 of the pitot tube 36, the velocity of the rotating body of fluid forces the fluid through the pitot tube inlet 38 and into the shaft 24, and through the passages 26. A radial bore 70 is provided in the drum 12 to permit noncondensable gas to exit the cavity 20 and assembly 10 via the passage 72. Additionally, a bearing lubrication supply passage 74 is provided to lubricate the bearing surfaces 28. The passages 72 and 74 parallel the passages 26.

If desired, a bearing and seal filter 62 can be placed in the shaft 24 to prohibit undesirable material from entering the bearing surfaces 28 and sealing surface 30.

From the foregoing, it will be appreciated that the single piece construction of the rotating drum 12 with a central bore 14 constructed during a single boring operation including thrust surface 42 perpendicular to the bore 14 machined during the same operation is efficient and inexpensive. One need only to construct the drum 12 from a single piece and form the central bore 14 in a single boring operation. In short, no extra steps or material (e.g., designing, machining and connecting the individual pieces) are required to produce an efficient pitot pump 10.

What is claimed:

1. A pitot pump assembly comprising;

a cylindrical rotating drum machined from a single piece, said rotating drum including a central bore constructed during a single boring operation set up, said rotating drum having a central cavity between its two axial ends in which fluid is received through one axial end of said rotating drum, said rotating drum having two radially extending openings in its periphery and located so as to attain dynamic balance of said rotating drum;

a cylindrical stationary shaft disposed within the central bore of said rotating drum and axially supported therein, said shaft including a plurality of nonconcentric, discrete fluid passages extending throughout a portion of its axial length;

two bearing surfaces and one sealing surface disposed between said shaft and said central bore of said rotating drum, said surfaces being concentric and having the same diameter;

a single piece pitot sub-assembly disposed within said cavity of said rotating drum and located axially to said stationary shaft, said pitot sub-assembly inserted through said radial openings of said rotating drum prior to the insertion of said stationary shaft, said pitot sub-assembly having a plurality of radially extending pitot tubes, said tubes having openings toward the rotating drum to receive fluid from within said cavity of said rotating drum;

a cylindrical sleeve encasing said rotating drum and secured thereto and rotatable therewith;

an outer housing secured to said stationary shaft, said housing encasing said sleeve and rotating drum.

2. The pitot pump assembly of claim 1 where said shaft includes a filter at one axial end, said filter having an outside diameter equal to the inside diameter of one of the passages in said shaft.

3. The pitot pump assembly of claim 1 where said rotating drum has a plurality of inlet flow paths.

4. The pitot pump assembly of claim 1 where one of said sleeve and said drum includes a motor rotor rigidly secured to and rotatable therewith.

5. The pitot pump assembly of claim 1 where said outer housing includes a motor stator.

6. The pitot pump assembly of claim 1 further including a transfer tube wherein said sleeve is secured to said transfer tube by a locating pin.

7. A pitot pump comprising;

a rotating drum machined from a single piece, said rotating drum including a bore constructed during a single boring operation set up, said rotating drum having a cavity between its two axial ends in which fluid is received through one axial end of said rotating drum, said rotating drum having at least one opening extending between the periphery of said drum and said cavity;

a stationary shaft inserted within the bore of said rotating drum and axially supported therein, said shaft including a plurality of nonconcentric fluid passages extending throughout a portion of its axial length;

at least two concentric sealing and bearing surfaces between said shaft and rotating drum, said surfaces having the same diameter and being formed during said single boring operation.

a pitot sub-assembly disposed within said cavity of said rotating drum and located to said stationary shaft, said pitot sub-assembly having one or more radially extending tubes, said tubes having openings to receive fluid from within said cavity of said rotating drum;

a sleeve on said rotating drum sealing said opening; and an outer housing secured to said stationary shaft, said housing encasing said sleeve and rotating drum.

8. A pitot pump comprising;

a rotating drum including a bore, said rotating drum having a cavity between its two axial ends in which fluid is received, said rotating drum having at least one radially extending opening;

a shaft inserted within the bore of said rotating drum and axially supported therein, said shaft including a fluid passage extending throughout a portion of its axial length, said shaft having one or more sealing and bearing surfaces between said shaft and rotating drum;

a unitary pitot sub-assembly disposed within said cavity of said rotating drum, said pitot sub-assembly inserted through said radial opening of said rotating drum, said pitot assembly having one or more radially extending pitot tubes, said tube(s) having an opening to receive fluid from within said cavity of said rotating drum;

means on said rotating drum and rotatable therewith for sealing said opening; and an outer housing secured to said stationary shaft, said housing encasing said rotating drum.

9. A method of making a pitot pump assembly which includes the steps of:

providing a one piece drum having an opening in its periphery extending to an internal cavity;

constructing a central bore in said drum constructed during a single boring operation to form a bore having at least two bearing and sealing surfaces that are concentric and have the same diameter and which intersects said central cavity;

inserting a pitot assembly through said opening in said drum into said cavity;

inserting said shaft through said central bore to mount said pitot assembly to said shaft; and sealing said opening in said drum.

10. The method of making a pitot pump assembly of claim 9 where opposite facing thrust surfaces perpendicular to said central bore are machined during the single boring operation.

* * * * *